US006921202B2

(12) United States Patent
Raterman

(10) Patent No.: US 6,921,202 B2
(45) Date of Patent: Jul. 26, 2005

(54) ELASTIC TRASH BAG

(75) Inventor: John M. Raterman, Atlanta, GA (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 10/285,233

(22) Filed: Oct. 31, 2002

(65) Prior Publication Data

US 2004/0086205 A1 May 6, 2004

(51) Int. Cl.[7] ..... B65D 33/00
(52) U.S. Cl. ..... 383/33; 383/43; 383/75
(58) Field of Search ..... 383/8, 33, 43, 383/75, 77

(56) References Cited

U.S. PATENT DOCUMENTS

| | | | | | |
|---|---|---|---|---|---|
| 4,244,408 | A | * | 1/1981 | Shoda | 383/2 |
| 4,509,570 | A | * | 4/1985 | Eby et al. | 141/390 |
| 4,747,701 | A | * | 5/1988 | Perkins | 383/33 |
| 4,953,704 | A | * | 9/1990 | Cortese | 206/493 |
| 5,040,902 | A | * | 8/1991 | Eaton et al. | 383/7 |
| 5,120,138 | A | * | 6/1992 | Midgley et al. | 383/7 |
| 5,232,118 | A | * | 8/1993 | Samuel | 220/495.11 |
| 5,404,999 | A | * | 4/1995 | Bednar | 206/204 |
| 5,568,979 | A | * | 10/1996 | Fifer et al. | 383/8 |
| 5,927,800 | A | * | 7/1999 | Stallworth | 297/188.08 |
| 5,997,178 | A | * | 12/1999 | Nye et al. | 383/33 |
| 6,059,458 | A | | 5/2000 | Belias et al. | |
| 6,164,824 | A | | 12/2000 | McGlew et al. | |
| 6,402,377 | B1 | | 6/2002 | Vo et al. | |
| 6,435,425 | B1 | | 8/2002 | Saidman | |
| 6,585,415 | B2 | * | 7/2003 | Malaspina | 383/75 |

FOREIGN PATENT DOCUMENTS

| | | | |
|---|---|---|---|
| EP | 1 013 567 A1 | 6/2000 | B65F/1/06 |
| EP | 1 266 837 A1 | 12/2002 | B65D/33/28 |

OTHER PUBLICATIONS

European Patent Office, *International Search Report,* Date of Mailing Jan. 27, 2004 (4 pages).
EPO, *Written Opinion,* International Application No. PCT/US03/31265, Dated Jun. 29, 2004 (5 pages).

* cited by examiner

*Primary Examiner*—Jes F. Pascua
(74) *Attorney, Agent, or Firm*—Wood, Herron & Evans LLP

(57) ABSTRACT

A trash bag incorporating a mouth securing system for securing the bag to a receptacle. The invention utilizes elastic strands, or alternatively elastic bands, adhesively attached to a trash bag and extending along the mouth of the bag. The elastic strands are attached to the bag while the strands are stretched. When the strands are allowed to return to their unstretched state, the bag gathers along the strands thereby providing a stretchable region along the mouth of the bag. The bag is configured so that when the strands are unstretched, the bag mouth is smaller than the receptacle opening, but when the strands are stretched, the bag mouth is larger than the opening. The bag is placed in the receptacle, the mouth stretched and placed over the receptacle opening. The elastic strands then retract creating a restoring force that secures the bag to the receptacle.

22 Claims, 6 Drawing Sheets

ELASTIC TRASH BAG

FIELD OF THE INVENTION

This invention relates generally to plastic trash bags and, more specifically, to trash bags having a securing system that enables the trash bag to be securely fitted to an upper portion of a trash container.

BACKGROUND OF THE INVENTION

Trash bags are typically formed from two panels of thermoplastic materials that are sealed along opposing vertical sides. The horizontal seam along the bottom of the panels is also sealed. The top side of the panels, however, is not sealed and provides an opening or mouth for access to the interior of the bag. The trash bag is inserted as an interior liner of a formed container or receptacle. The bag mouth is then loosely laid over the top end of the receptacle to provide an unobstructed opening for inserting trash into the bag.

A differentiating feature in many trash bag designs, however, is the bag closure system. In the typical trash bag closure system, the bag adjacent to the opening is gathered together at a point some distance below the mouth. If there is sufficient bag length above the gathering point, this length may be tied into a knot to secure its contents. Otherwise, a separate bag tie may be used to secure the bag from reopening. Typical bag ties are paper coated flexible wires or a plastic strip with a self-adjusting locking mechanism. Having separate tie mechanisms is often undesirable due to the additional expense in manufacturing and the inconvenience they cause the consumer.

One way to avoid these problems is to have a closure system integral to the overall bag design. One particular integral bag closure system includes tie members that are simple extensions of the bag body. In this system, an extra length of plastic integral to the bag body extends above the mouth on opposing sides of the bag. Now instead of gathering the plastic at a point below the mouth, the mouth may in essence become the gathering point and the two lengths of plastic extending upwardly from the mouth are used to tie a knot in order to secure the bag contents.

Another integral bag closure system includes a drawtape or drawstring internal to a hem formed along the mouth of the bag to form a so-called cinch. The hem may be formed by folding the plastic of the bag body over itself a short length and heat sealing the seam with the drawtape/drawstring internal to the hem. In this design, the hem is provided with one or more access holes that allow the drawtape/drawstring to be pulled through, gathering the bag along its mouth to secure its contents. The drawtape/drawstring advantageously serves as a handle for which to carry the bag. Furthermore, if two access holes are provided, the drawtape can then be tied together in a knot to ensure that the contents stay inside the bag while also providing a handle for which to carry the bag.

One shortcoming of traditional trash bags as well as trash bags with integral closure systems is the securing of the bag mouth to the opening of the receptacle. For many trash bags, the bag mouth is loosely laid over the container edge. When consumers fill the trash bag, the bag mouth often becomes detached from the formed container and consequently falls down inside the container. This may occur from the shear weight of the inserted trash or from simply dragging the mouth into the bag as the consumer repeatedly inserts trash into the bag. The consumer must then pick up the bag relative to the container and put the mouth back over the top edge of the container. Otherwise, the consumer risks missing the inside of the bag completely and having trash in immediate contact with the inside surface of the container. This defeats the purpose of the bag and creates a nuisance for the consume.

A mouth securing system has been proposed to overcome this shortcoming by inserting an elastic ring inside a hem formed along the mouth of the bag. The ring or loop element is not attached to the bag but instead just freely floats within the formed hem. The ring may be completely made from elastic material or have only a portion made from elastic material. This mouth securing system may be used with a cinch-type closure system. A number of disadvantages exist in this design. First, because the elastic ring is not attached to the bag, it requires that a hem be formed along the mouth of the bag which adds to the manufacturing cost of the bag. Without the hem, the ring would simply slide off the bag in its unstretched state. Second, this design requires that the loop completely traverse the mouth of the bag. Again, because the elastic ring is free floating and not attached to the bag, stretching along the mouth can only occur if the ring forms a closed loop. Anything less than a closed looped ring would not be effective in this design.

Another mouth securing system has been proposed that augments a closure system utilizing a drawtape design with an elastic member adhered to the drawtape. In essence, the securing system is incorporated into the closure system. In this design, a section of the drawtape is gathered into folds forming a plurality of crests and troughs. An unstretched elastomeric strip is then attached to the troughs of the gathered drawtape. This provides the drawtape with a level of elasticity related to the length of drawtape attached to the elastic strip. When the drawtape is stretched, the elastic strip stretches moving the drawtape crests closer to the troughs. The drawtape may stretch until the crests and troughs are substantially coplanar. Any further stretching results in plastic deformation of the drawtape just as if there were no elastic member. The augmented drawtape is incorporated within a hem about the mouth of the bag as previously discussed. For this design to be effective as a way to secure the bag mouth to the receptacle, the unstretched mouth opening must be smaller than the receptacle opening. In this way, the mouth must then be stretched to cover the container opening, thus creating an elastic restoring force that secures the bag to the receptacle.

This design, however, also has some disadvantages. First, this mouth securing system is limited to trash bag designs having closure systems that employ drawtapes or drawstrings. This is a significant disadvantage because the drawtape manufacturing process is more expensive, requires additional materials, and requires more steps than other closure systems. Furthermore, this design attaches the elastic member to the drawtape at discrete locations along the drawtape, i.e., at the troughs of the gather sections, which complicates the manufacturing process and thereby may add cost to the bag.

Therefore, a need exists for a system that secures the mouth of a trash bag to a container but that overcomes the disadvantages of the previous designs and additionally works with a host of closure systems.

SUMMARY OF THE INVENTION

The present invention overcomes the foregoing and other shortcomings and drawbacks of securing systems designed to secure trash bags to receptacles. While this invention will be described in connection with certain embodiments, it will be understood that the invention is not limited to these embodiments. On the contrary, the invention includes all alternatives, modifications, and equivalents as may be included within the spirit and scope of the present invention.

The present invention discloses a securing system utilizing elastic strands, or alternatively elastic bands, adhesively attached to a trash bag and extending along the bag mouth. There may be one or more elastic strands or bands of various lengths that encircle the entire bag or only a selected portion thereof. The elastic strands or bands are adhesively attached to the bag while the strands or bands are stretched, or elongated. The adhesive may be applied to the strands or bands in a continuous manner or at discrete points along the strands or bands. When the strands or bands are allowed to return to their unstretched state, the bag gathers along the strands or bands thereby providing a stretchable region along the mouth of the bag. The trash bag and attached elastic strands or bands are configured so that when the strands or bands are unstretched, the bag mouth is smaller than the receptacle opening, but when the elastic strands or bands are stretched, the bag mouth is larger than the receptacle opening. With this design, a consumer inserts a bag into a receptacle, stretches the bag mouth to be larger than the receptacle opening, places the bag mouth over the receptacle opening, and then releases the bag. The elastic strands or bands retract creating a restoring force along the bag mouth that secures the bag to the receptacle.

The elastic strands or bands may be placed along the mouth of the bag in several different configurations. In accordance with one aspect of the present invention, a single strand or band completely encircles the mouth of the bag as a ring proximate the bag mouth. In accordance with another aspect of the present invention, multiple strands or bands that completely encircle the bag mouth as rings may be placed adjacent each other proximate the bag mouth to further secure the bag to the receptacle. In accordance with yet another aspect of the present invention, multiple elastic strands or bands are spaced circumferentially about the bag mouth so that in their unstretched state, the bag mouth is smaller than the receptacle opening and in the stretched state, the bag mouth is larger than the receptacle opening.

The securing system of the present invention may be easily incorporated into existing bags with or without integral closure systems. For traditional trash bags with no integral closure system, the elastic strands or bands previously described may be placed immediately adjacent the bag mouth, in which case a separate bag tie would have to be used at a gathering point somewhere below the strands. In one exemplary embodiment, the elastic strands or bands may be hidden by forming a hem along the mouth of the bag by folding the top edge over the bag for a distance to cover the strands or bands and sealing the edge of the hem to the bag body. The elastic strands or bands are fully enclosed within the hem. Alternatively, the elastic strands or bands may be placed some distance away from the mouth end to provide a length of bag material sufficient to tie a knot or otherwise provide a gathering point somewhere above the strands or bands that would be secured using a separate bag tie.

The securing system of the present invention may also be easily incorporated into trash bags with integral closure systems. For trash bags that shape or contour the bag in order to provide integral tie ends extending above the bag mouth, the elastic strands or bands previously described may be placed adjacent the bag mouth. When the bag is full, the mouth is stretched and removed from the receptacle and the integral tie ends are used to secure the bag contents. For cinch-type closure systems, the elastic strands or bands may be placed within the hem, below the hem, or on the drawtape itself. In this way, the strands or bands effectively secure the bag to the receptacle while the cinch effectively closes the bag and may further provide a handle for which to carry the bag.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE PREFERRED EMBODIMENT

Figure 1:
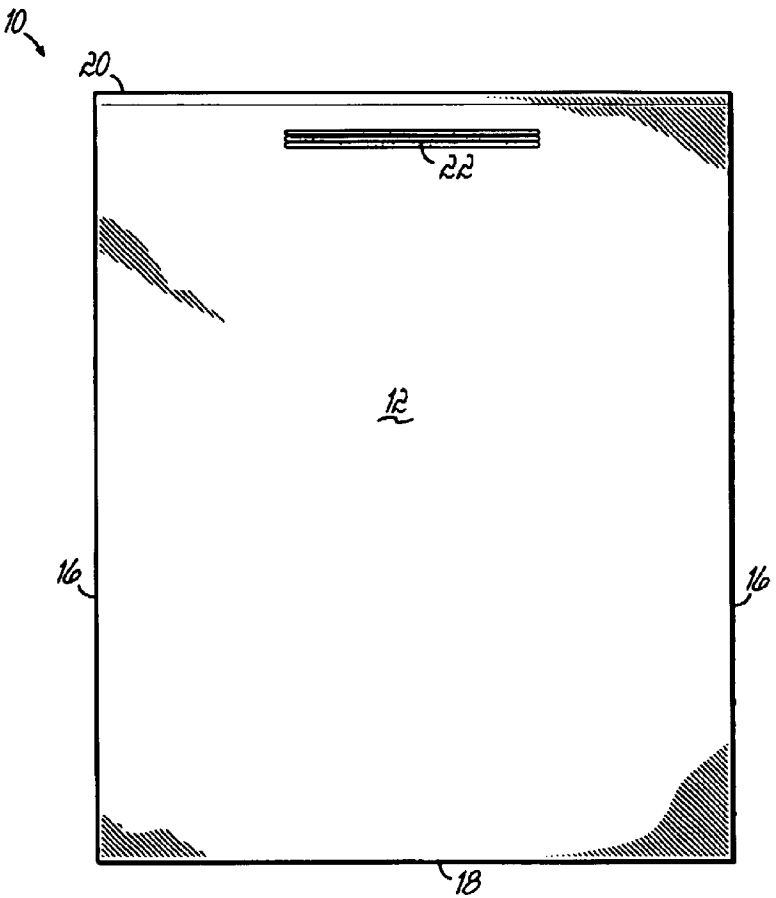
FIG. 1 is a side elevational view of an elastic trash bag with elastic strand segments adhered along their entire lengths to the trash bag proximate the bag mouth in accordance with the principles of the present invention.

Referring to FIG. 1, an elastic trash bag 10 is schematically illustrated in accordance with one embodiment of the present invention and comprises a trash bag body having two panels of plastic 12 and 14 (FIG. 2) that are sealed along two vertical sides 16 and along the bottom side 18 of the two panels 12 and 14. The top side of the panels 12 and 14 is not sealed and thereby provides an opening or mouth 20 for access into the interior of the bag. It will be appreciated that other formations of the trash bag 10 known to those skilled in the art are possible as well.

Figure 2:
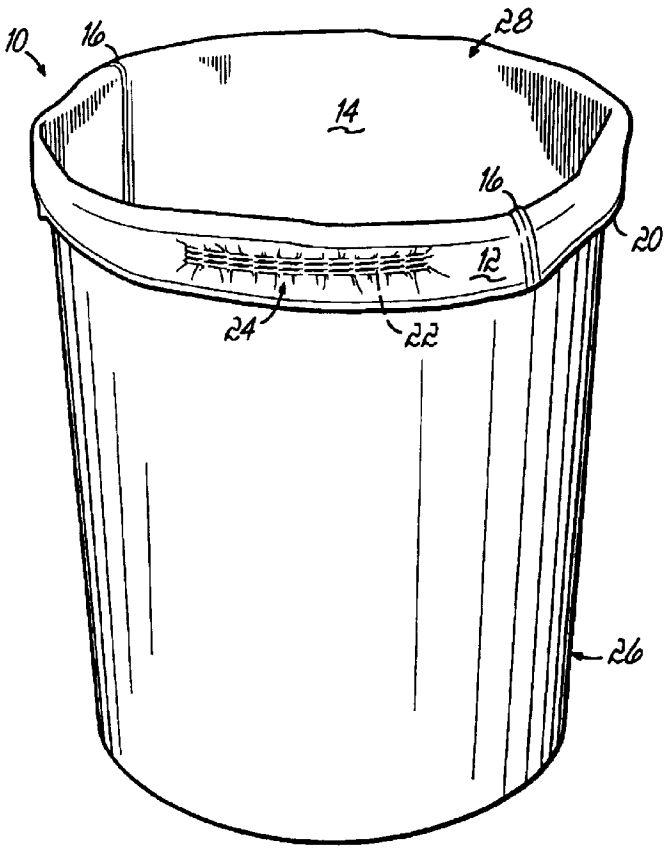
FIG. 2 is a perspective view of an elastic trash bag with elastic strand segments adhered intermittently along their lengths to the trash bag proximate the bag mouth in accordance with the principles of the present invention and shown securely mounted to a trash receptacle.

In one embodiment of the present invention, multiple elastic strand segments 22 are adhesively attached to the trash bag 10 and extend generally parallel to the bag mouth 20 and are positioned relatively close to the bag mouth. The elastic strands 22 are attached to at least one of the plastic panels 12 and 14 while the strands 22 are stretched or elongated. In accordance with one embodiment, the adhesive may be applied to the strands 22 in a continuous manner along the entire length of the strands 22 as shown in FIG. 1 so that the elastic strands 22 are adhered to the bag 10 along their entire lengths. Alternatively, the strands 22 may be adhered to the bag 10 at discrete spaced locations along the length of the strands 22 as shown in FIG. 2. When the strands 22 return to their unstretched state (see FIG. 2,) the bag panels 12 and 14 gather along the strands 22 thereby providing a stretchable region 24 along the mouth of the bag 20.

The strands 22 may comprise elastic strands of LYCRA XAJ Spandex, a synthetic stranded product manufactured by DuPont, or any other stranded elastic products such as threaded natural rubber by way of example. It will be appreciated by those of ordinary skill in the art that strands 22 may be replaced with one or more generally flat bands (not shown) without departing from the spirit and scope of the present invention. The strands 22 can be adhesively attached to the bag 10 in a number of different manners such as, by way of example, applying the adhesive as a spray, a continuous band, a continuous swirl spray, a non-looping swirl spray in the shape of an omega or sinusoid or as multiple adhesive dots as known by those skilled in the art. Examples of several of these adhesive dispensing patterns are fully disclosed in U.S. Pat. No. 6,435,425, entitled Module and Nozzle for Dispensing Controlled Patterns of Liquid Material U.S. Pat. No. 6,582,518, entitled Guide System for Positioning an Elongated Strand in a Liquid Dispensing Environment, and co-pending U.S. Ser. No. 10/021,176, entitled Method and Apparatus for Use in Coating Elongated Bands, each disclosure of which is hereby incorporated herein by reference in its entirety.

Referring to FIG. 2, the trash bag 10 is inserted as an interior liner of a formed container or receptacle 26 having an opening 28. The trash bag 10 and attached elastic strands 22 are configured so that when the elastic strands 22 are unstretched, the bag mouth 20 is smaller than the receptacle opening 28. But when the strands 22 are stretched, the bag mouth is larger than the receptacle opening 28. Thus, to secure the bag 10 to receptacle 26, the consumer inserts a bag into the receptacle opening 28, stretches the bag mouth 20 to be larger than opening 28 and places the bag mouth 20 over opening 28. When the consumer releases the bag mouth 20, the elastic strands 22 retract and create a restoring force along the bag mouth 20 that secures the bag to the receptacle.

Figure 3B:
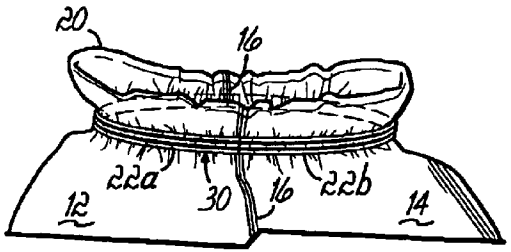
FIG. 3B is a side elevational view of an elastic trash bag of the present invention wherein each elastic ring that encircles the bag mouth comprises a pair of elastic strand segments attached to the bag to form the rings.
Figure 3C:
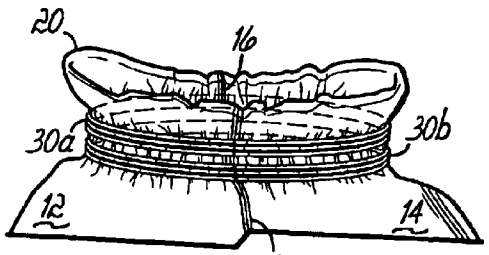
FIG. 3C is a side elevational view of an elastic trash bag of the present invention having multiple ring sets that encircle the entire mouth of the bag.
Figure 3A:
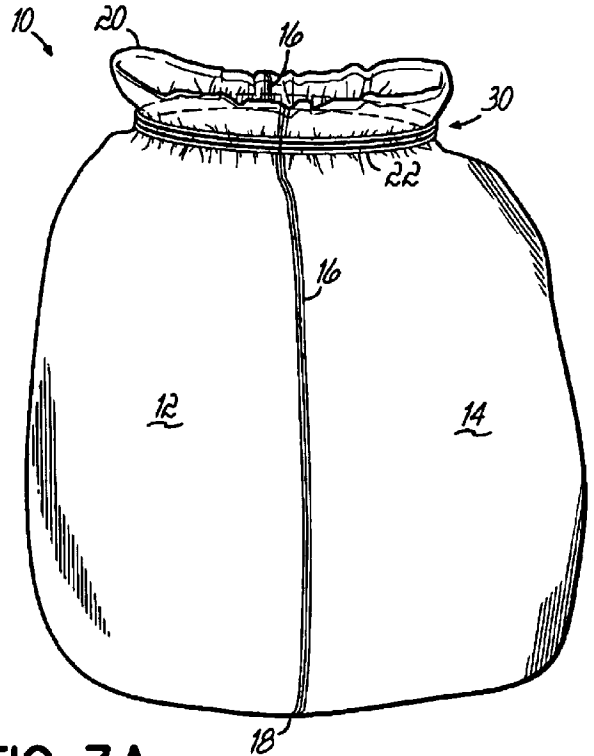
FIG. 3A is a side elevational view of an elastic trash bag of the present invention wherein the elastic strands are elongated to encircle the entire mouth of the bag to form multiple elastic rings.

The elastic strands 22 may be placed generally parallel to the mouth of the bag 10 in several different configurations. FIGS. 3A–3C illustrate several strand configurations according to the principles of the present invention. FIG. 3A shows one embodiment wherein the elastic strands 22 completely encircle the bag mouth 20. This type of configuration might be accomplished by using a single strand 22 or multiple strands 22 (three (3) shown) that are either continuously or intermittently adhered to the panels 12 and 14 to form a single ring set 30 which encircles the bag mouth 20.

In another embodiment as shown in FIG. 3B, each ring in set 30 may be composed of two discrete strand segments 22*a* and 22*b* that abut each other end-to-end to form a complete ring. FIG. 3C shows another embodiment of the present invention wherein multiple ring sets 30*a* and 30*b* may be formed to secure the bag 10 to the receptacle 26. Multiple ring sets 30*a* and 30*b* might be appropriate when the bag 10 must hold a significant amount of weight or perhaps the bag is not supported along the bottom.

Figure 4A:
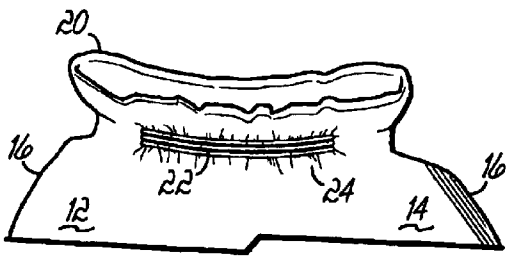
FIG. 4A is a side elevational view of an elastic trash bag of the present invention having a pair of elastic strand segments attached to the bag proximate the bag mouth.
Figure 4B:
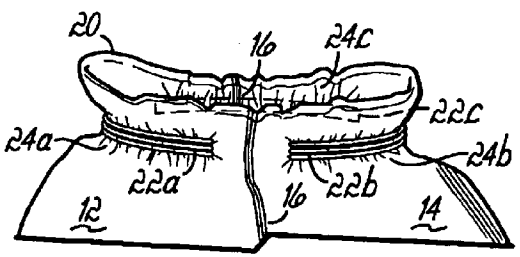
FIG. 4B is a side elevational view of an elastic trash bag of the present invention having multiple elastic strand segments spaced circumferentially about the bag mouth.

FIGS. 4A–4B show additional embodiments of strand configurations. FIG. 4A shows one embodiment of the present invention wherein a pair of discrete segments of elastic strands 22 (one shown) are adhered along their entire respective lengths to the bag 10 and extend proximate the mouth end 20 for respective lengths less than the width of either bag panel 12 or 14. Alternatively, the discrete segments of elastic strands 22 may be adhered to the bag 10 at intermittent locations as shown in FIG. 2. The minimum length for strands 22 in this configuration is a length such that when the stretchable region 24, defined by strands 22, is fully expanded, the bag mouth 20 is just slightly larger than the receptacle opening 28 thus allowing the bag mouth 20 to be placed over the receptacle opening 28. This configuration is advantageous in that it minimizes the amount of elastic material used to secure the bag 10 to the receptacle 26.

FIG. 4B shows another embodiment of the present invention wherein multiple discrete strand segments 22*a*, 22*b*, and 22*c* are spaced circumferentially about the bag mouth 20 to provide multiple points along the receptacle opening 28 where the bag 10 is secured to receptacle 26. The strand segments 22*a*, 22*b* and 22*c* may each have equal lengths and may be uniformly spaced about the mouth end 20, although other configurations are possible as well. The strand segments 22*a*, 22*b* and 22*c* may be adhered to the bag 10 along their entire respective lengths or at intermittent locations. The lengths for the bands 22*a*, 22*b* and 22*c* for this configuration are provided such that when all the stretchable regions 24*a*, 24*b*, and 24*c* are fully expanded, the bag mouth 20 is just slightly larger than the receptacle opening 28 thus allowing the bag mouth 20 to be placed over receptacle opening 28.

Figure 5B:
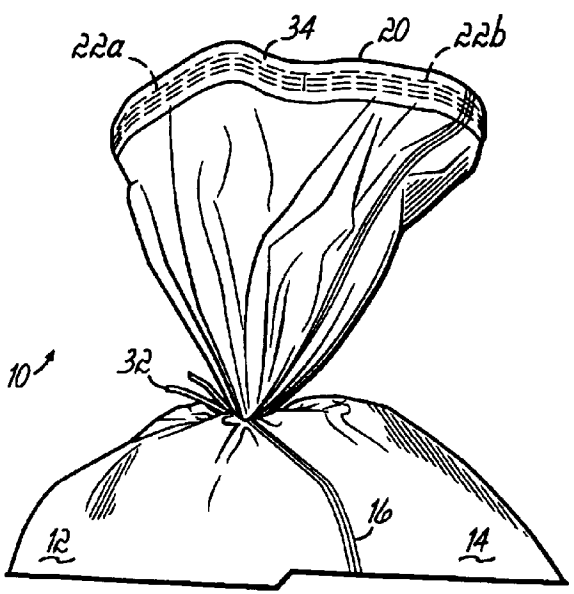
FIG. 5B is a side elevational view of an elastic trash bag of the present invention having a hem formed about the mouth of the bag and elastic strands located within the hem.
Figure 5A:
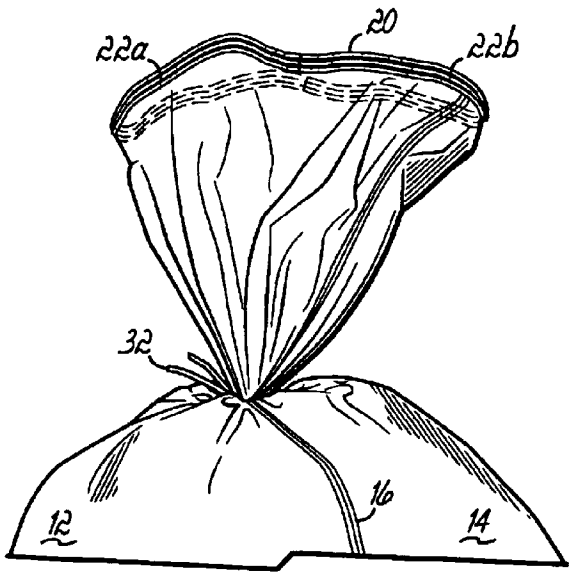
FIG. 5A is a side elevational view of an elastic trash bag of the present invention wherein a bag tie closes the bag below elastic strands which encircle the bag mouth.

The securing system of the present invention is adaptable to not only traditional trash bags but also to bags having integral closure systems. FIG. 5A shows one embodiment of the present invention adapted to a traditional trash bag. FIG. 5A shows elastic strand segments 22*a* and 22*b* placed immediately adjacent the bag mouth 20. The strand segments 22*a* and 22*b* are adhered to the bag 10 end-to-end to form complete rings. When the bag is full, the bag is gathered together at a point below the strands 22*a*, 22*b* and a separate bag tie 32 is used to prevent the bag from reopening. Preferably, the strand segments 22*a* and 22*b* are hidden from view by forming a hem 34 along bag mouth 20 and placing the strands internal to the hem as shown in FIG. 5B.

Figure 6:
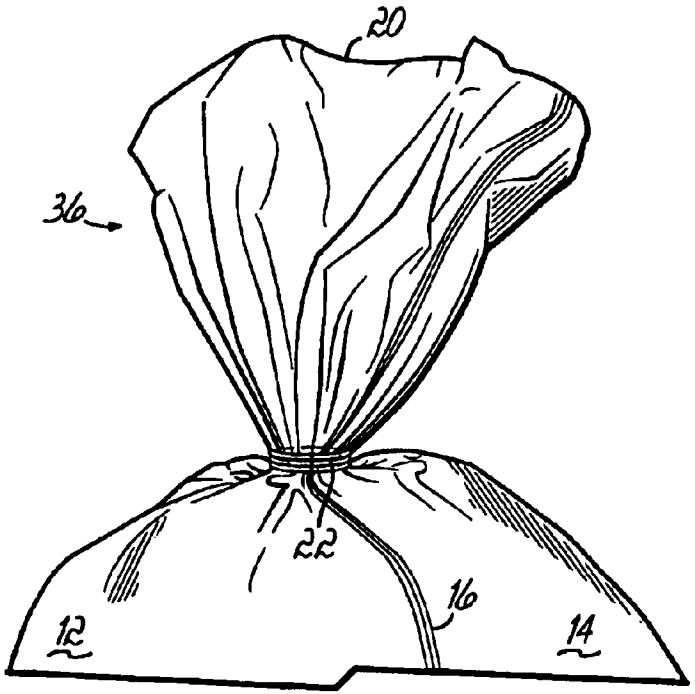
FIG. 6 is a side elevational view of an elastic trash bag of the present invention wherein elastic strands are spaced a distance from the bag mouth.

FIG. 6 shows an alternate embodiment for traditional trash bags wherein the elastic strands 22 are located some distance away from bag mouth 20 to provide a length of bag material 36 sufficient to tie a knot or provide a gathering point above the bands that could be secured using a separate bag tie 32.

Figure 7:
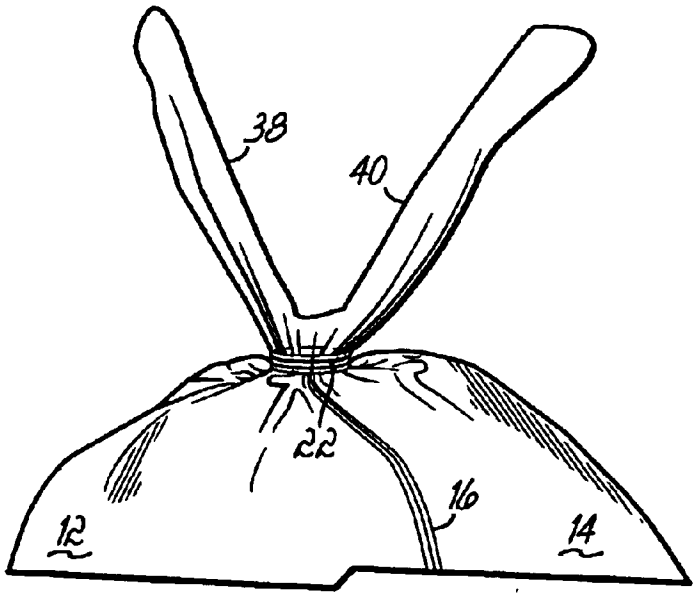
FIG. 7 is a side elevational view of an elastic trash bag of the present invention incorporating integral tie ends extending above the bag mouth that are used to close the bag.

The securing system of the present invention may also be easily incorporated into trash bags with integral closure systems. FIG. 7 illustrates one embodiment of a securing system used in conjunction with a trash bag that is shaped or contoured in order to provide integral tie ends 38 and 40 extending above bag mouth 20. Elastic strands 22 may be placed proximate the bag mouth 20. When the bag is full, the integral tie ends 38 and 40 are used to tie a knot to prevent the bag from reopening.

Figure 8A:
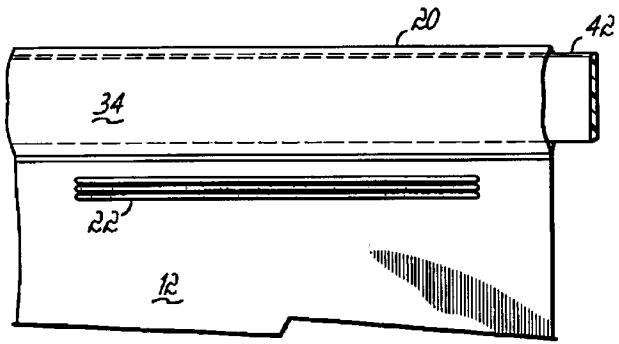
FIG. 8A is a side elevational view of an elastic trash bag of the present invention incorporating a drawtape closure system within a hem, wherein elastic strand segments are located below the hem.
Figure 8B:
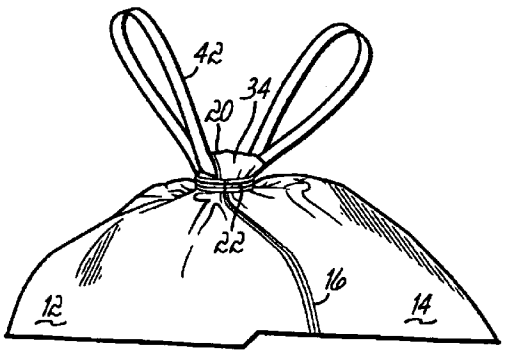
FIG. 8B is a perspective view of an elastic trash bag of the present invention with the bag removed from the trash receptacle and closed using a drawtape, wherein elastic strands encircle the entire mouth of the bag to form multiple elastic rings.
Figure 8D:
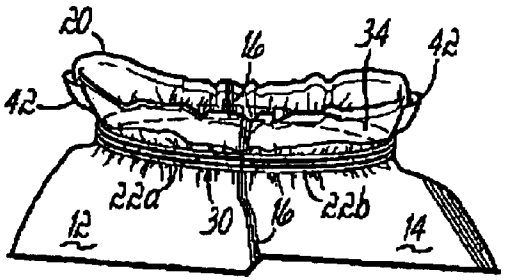
FIG. 8D is a side elevational view of an elastic trash bag of the present invention wherein the elastic ring comprises a pair of elastic strand segments that encircle the entire mouth of the bag as in FIG. 3B.
Figure 8E:
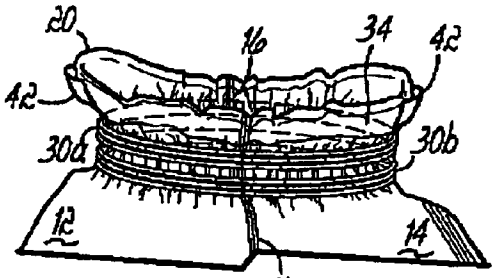
FIG. 8E is a side elevational view of an elastic trash bag of the present invention having multiple ring sets that encircle the entire mouth of the bag as in FIG. 3C.
Figure 8F:
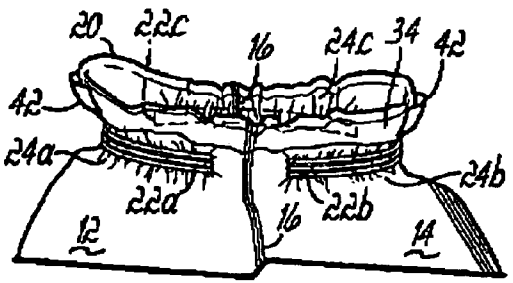
FIG. 8F is a side elevational view of an elastic trash bag of the present invention having multiple elastic strand segments spaced circumferentially about the bag mouth as in FIG. 4B.
Figure 8C:
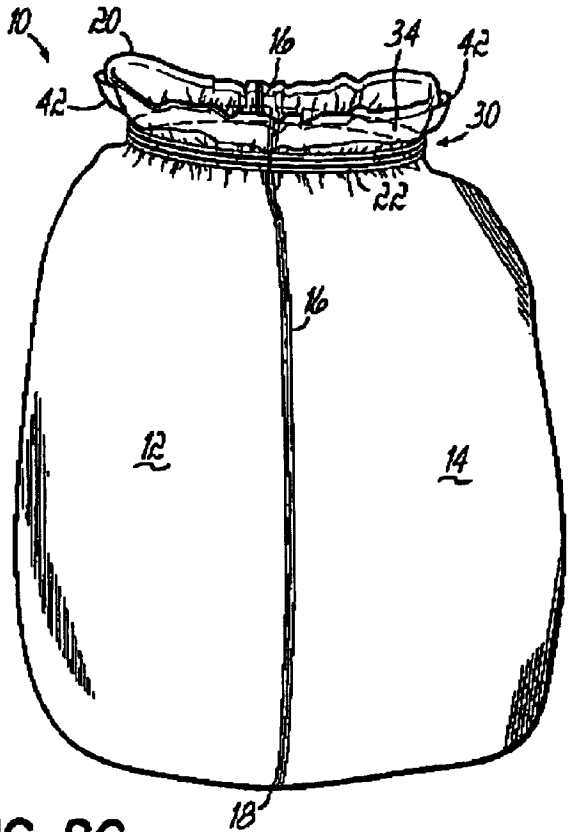
FIG. 8C is a side elevational view of an elastic trash bag of the present invention wherein the elastic strands encircle the mouth of the bag to form elastic rings as in FIG. 3A.

FIGS. 8A–8F further illustrate embodiments of the present invention used in cinch-type closure systems. Cinch-type closure systems have a drawtape/drawstring 42 internal to a bag hem 34 that encircles the bag mouth 20. Elastic strands 22 may be placed below the hem 34 as shown in FIG. 8 A. The strands 22 secure the bag 10 to the receptacle 26 and when the bag is full, the drawtape/drawstring 42 is used to secure the bag contents and provide a handle to carry the bag, as shown in FIG. 8B. As discussed previously, the elastic members 22 may completely encircle the baa mouth 20 to form a single ring set (FIG. 8C) or the ring set 30 may be composed of two discrete strand segments 22*a* and 22*b* that abut each other end-to-end for form a complete ring (FIG. 8D). As shown in FIG. 8E. multiple ring sets 30*a* and 30*b* may be formed along the mouth of the bag. Additionally, as shown in FIG. 8F, multiple discrete strand segments 22*a*, 22*b*, and 22*c* may be spaced circumferentially about the bag mouth 20.

Figure 9:
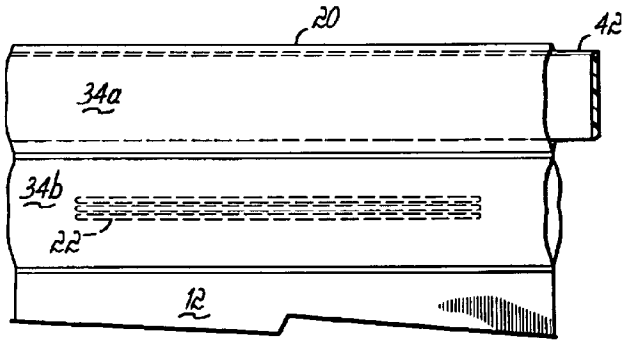
FIG. 9 is a side elevational view of an elastic trash bag of the present invention wherein a double hem is formed, the first hem containing a drawtape and the second hem containing elastic strand segments.
Figure 10:
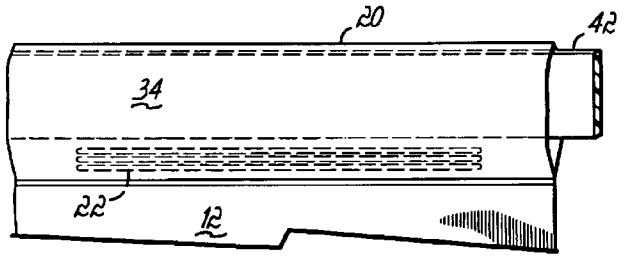
FIG. 10 is a side view of an elastic trash bag of the present invention wherein a drawtape and elastic strand segments are contained inside a single hem.

FIG. 9 shows an alternate embodiment for cinch-type closure systems wherein trash bag 10 has two hems 34*a* and 34*b*, with the top hem 34*a* preferably containing the drawtape/drawstring 42 and the bottom hem 34*b* preferably containing elastic strands 22. FIG. 10 shows another embodiment wherein the elastic strands 22 and the drawtape/drawstring 42 are contained in a single hem 34.

Figure 11:
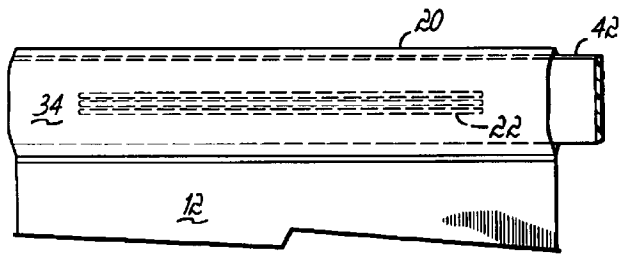
FIG. 11 is a side view of an elastic trash bag of the present invention wherein elastic strand segments are attached to a drawtape located within a single hem.

FIG. 11 shows yet another embodiment for a cinch-type closure system wherein the elastic strands 22 are attached to the drawtape 42 and enclosed in the hem 34. The drawtape 42 is generally flat, i.e. ungathered, so that the strands 22 lie generally parallel with the drawtape 42. In this design, the elastic cinch secures the bag mouth 20 to the receptacle 26 and further provides for closure of the bag and a handle for which to carry the bag.

Those of ordinary skill in the art will recognize the many other configurations of strands 22 and bands (not shown) that will effectively secure the bag 10 to the receptacle 26 without departing from the spirit and scope of the present invention.

While the present invention has been illustrated by a description of various embodiments and while these embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

Having described the invention, what is claimed is:

1. A trash bag for a receptacle having an opening to receive the bag, the trash bag comprising:

a trash bag body having an open bag mouth;

a plurality of longitudinally spaced elastic strands defining at least one elongated elastic member adhesively attached directly to a surface of said trash bag body and extending proximate said bag mouth, said elastic member having an unstretched state and a stretched state, said elastic member being adhesively attached to said surface of said trash bag body while in the stretched state, the adhesive being applied to said at least one elongated elastic member in a manner selected from the group consisting of a spray, a continuous band, a continuous swirl, an omega swirl, a sinusoidal swirl and multiple dots; and a hem formed proximate said bag mouth, wherein said elastic member is attached to said trash bag body within said hem.

2. The trash bag of claim 1, wherein said bag mouth has at least two tie ends extending from said bag mouth.

3. The trash bag of claim 1, wherein said elastic member forms a ring that encircles said bag mouth.

4. The trash bag of claim 3, wherein said ring comprises at least two of said elastic members attached to said trash bag body end-to-end.

5. The trash bag of claim 1, further comprising a plurality of elastic members attached to said trash bag body.

6. The trash bag of claim 5, wherein said plurality of elastic members form a plurality of rings that encircle said bag mouth.

7. The trash bag of claim 5, wherein said plurality of elastic members are spaced circumferentially about said bag mouth.

8. A trash bag for a receptacle having an opening to receive the bag, the trash bag comprising:

a trash bag body having an open bag mouth;

a hem formed proximate said bag mouth and having at least one opening in said hem;

one of a drawtape and a drawstring contained within said hem, said one of said drawtape and drawstring being accessible at the opening of said hem to allow said one of said drawtape and drawstring to be pulled therethrough relative to said trash bag body so as to close said bag mouth; and a plurality of longitudinally spaced elastic strands defining at least one elongated elastic member adhesively attached directly to a surface of said trash bag body within said hem and extending proximate said bag mouth, said elastic member having an unstretched state and a stretched state, said elastic member being attached to said surface of said trash bag body while in the stretched state.

9. The trash bag of claim 8, wherein said hem defines a first annular channel and a second annular channel, said one of said drawtape and drawstring being contained in one of said the first and second annular channels and said elastic member being contained in said other of said first and second annular channels.

10. The trash bag according to claim 8, wherein said elastic member forms a ring that encircles said bag mouth.

11. The trash bag of claim 10, wherein said ring comprises at least two of elastic members attached to said trash bag body end-to-end.

12. The trash bag of claim 8, further comprising a plurality of elastic members attached to said trash bag body.

13. The trash bag of claim 12, wherein said plurality of elastic members form a plurality of rings that encircle said bag mouth.

14. The trash bag of claim 12, wherein said plurality of elastic members are spaced circumferentially about said bag mouth.

15. The trash bag of claim 8, wherein the adhesive is applied to said at least one elongated elastic member in a manner selected from the group consisting of a spray, a continuous band, a continuous swirl, an omega swirl, a sinusoidal swirl and multiple dots.

16. A trash bag for a receptacle having an opening to receive the bag, the trash bag comprising:

a trash bag body having an open bag mouth;

a hem formed proximate said bag mouth and having at least one opening in said hem;

one of a drawtape and a drawstring contained within said hem, said one of said drawtape and drawstring being accessible at the opening of said hem to allow said one of said drawtape and drawstring to be pulled therethrough relative to said trash bag body so as to close said bag mouth; and a plurality of longitudinally spaced elastic strands defining at least one elongated elastic member adhesively attached directly to a surface of said trash bag body and extending proximate said bag mouth, said elastic member having an unstretched state and a stretched state, said elastic member being attached to said surface of said trash bag body while in the stretched state;

wherein said hem defines a first annular channel and a second annular channel, said one of said drawtape and drawstring being contained in one of said the first and second annular channels and said elastic member being contained in said other of said first and second annular channels.

17. The trash bag according to claim 16, wherein said elastic member forms a ring that encircles said bag mouth.

18. The trash bag of claim 17, wherein said ring comprises at least two of elastic members attached to said trash bag body end-to-end.

19. The trash bag of claim 16, further comprising a plurality of elastic members attached to said trash bag body.

20. The trash bag of claim 19, wherein said plurality of elastic members form a plurality of rings that encircle said bag mouth.

21. The trash bag of claim 19, wherein said plurality of elastic members are spaced circumferentially about said bag mouth.

22. The trash bag of claim 16, wherein the adhesive is applied to said at least one elongated elastic member in a manner selected from the group consisting of a spray, a continuous band, a continuous swirl, an omega swirl, a sinusoidal swirl and multiple dots.

* * * * *

UNITED STATES PATENT AND TRADEMARK OFFICE

CERTIFICATE OF CORRECTION

PATENT NO. : 6,921,202 B2
DATED : July 26, 2005
INVENTOR(S) : John M. Raterman

It is certified that error appears in the above-identified patent and that said Letters Patent is hereby corrected as shown below:

Column 2,
Line 5, change “consume” to -- consumer --.

Column 7,
Line 46, change “baa” to -- bag --.
Line 49, change “for” to -- to --.

Column 9,
Line 10, delete “the”.

Column 10,
Line 14, delete “the”.

Signed and Sealed this

Twentieth Day of December, 2005

JON W. DUDAS
*Director of the United States Patent and Trademark Office*